United States Patent [19]

Lambiris

[11] 4,063,872

[45] Dec. 20, 1977

[54] UNIVERSAL BURNER

[75] Inventor: Sotiris Lambiris, Andover, Mass.

[73] Assignee: General Electric Company, Schenectady, N.Y.

[21] Appl. No.: 677,723

[22] Filed: Apr. 16, 1976

[51] Int. Cl.[2] ..... A23C 9/00

[52] U.S. Cl. ..... 431/285; 431/158; 431/353

[58] Field of Search ..... 431/174, 175, 176, 284, 431/285, 352, 158; 23/277 C, 259.5

[56] References Cited

U.S. PATENT DOCUMENTS

| | | | |
|---|---|---|---|
| 3,179,151 | 4/1965 | Reed | 431/174 |
| 3,367,384 | 2/1968 | Voorheis | 431/9 |
| 3,376,098 | 4/1968 | Pryor | 431/158 |
| 3,545,918 | 12/1970 | Frundl et al. | 110/8 A |
| 3,979,141 | 8/1976 | Sweet | 431/352 |

*Primary Examiner*—Edward G. Favors

*Assistant Examiner*—Robert J. Charvat

*Attorney, Agent, or Firm*—James W. Mitchell; John F. Ahern; Herbert E. Messenger

[57] ABSTRACT

This disclosure pertains to wall burners which are used to raise the temperature of a gas stream flowing through a duct. Wall burners are mounted outside the duct and fire into the duct through a porthole formed in the duct wall. The present invention is uniquely characterized by a pre-main combustion chamber wherein a combusting fuel-air mixture is generated using only a small amount of the total fuel expended by the burner. The combusting mixture travels downstream through an accelerator ring and into the duct at high velocity and momentum. On the downstream side of the accelerator ring, main fuel ports inject the major portion of the fuel expended into the combusting fuel-air mixture whereupon a transfer of heat and momentum takes place which carries the unburned main fuel into the duct where the main combustion process takes place.

13 Claims, 2 Drawing Figures

UNIVERSAL BURNER

BACKGROUND OF THE INVENTION

This invention relates, in general, to an apparatus for raising the temperature of a gas stream; and, in particular, this invention relates to burners of the type characterized as wall mounted burners.

One particular application for the present invention is found in that portion of a combined cycle power plant referred to as a heat recovery steam generator (HRSG). A HRSG is a generally vertical free standing duct which envelops a boiler tube bundle whereby gas turbine exhaust gases are channeled through the duct in a heat exchange relationship with fluid in the tube bundle in order to raise the temperature of the tube bundle fluid to generate steam for driving a steam turbine. It is sometimes desirable to raise the temperature of the exhaust gas flow upstream from the tube bundle by using burners in which case the HRSG is referred to as being "fired". One example of a fired HRSG is given in U.S. Pat. No. 3,830,620 to Frederick J. Martin issued Aug. 20, 1974. The Martin patent shows a grid burner system which includes a network of fuel supplied burner pipes which are disposed within and across the cross-section area of the HRSG duct. Each pipe includes a plurality of fuel outlet ports on the downstream (with respect to the exhaust gas flow) surfaces of the pipes. Fuel is delivered to the outlet ports through the grid pipes and ignited by pilot burners mounted transversely to the grid pipes and downstream therefrom.

One inherent limitation in grid burner systems is the type of fuels which can be burned in order to avoid pipe clogging. Grid burner systems, in general, require natural gas or distillate fuels for operation. Grid burner systems are expensive to manufacture and install. Moreover, grid burner systems are also difficult to maintain.

A contributing factor to the aforementioned grid burner disadvantages is that the grid system is disposed within the HRSG where the hot flowing gases may cause decomposition of liquid fuels. An alternative solution to the grid burner system is a wall mounted burner which is located outside the exhaust gas duct. A wall burner shoots its flame into the duct through a port formed in one of the duct walls. Hence, the wall burner is not subject to clogging and is available for easy maintenance. One example of a prior art wall burner is given in U.S. Pat. No. 3,367,384 to Voorheis issued Feb. 6, 1968. The Voorheis burner is a liquid fuel burner wherein the totality of the fuel is supplied from a liquid fuel nozzle located upstream from a pre-main combustion chamber.

SUMMARY OF THE INVENTION

The wall burner of the present invention is characterized by a unique construction which produces novel and unobvious results. The unique construction is highlighted by the inclusion of an accelerator ring at the downstream end of a pre-main combustion chamber and the presence of main fuel ports on the downstream side of the accelerator ring. The unique construction is further emphasized by a preferred mode of operation wherein only a small amount of fuel is supplied to the pre-combustion chamber and wherein the overwhelming amount of the total fuel supply is through the main fuel ports downstream from the accelerator ring. Moreover, the burner is a dual fuel universal burner in that the burner will operate efficiently on both liquid hydrocarbon fuels including heavier commercial grades (No. 6 Oil) and gaseous fuels including low calorific content fuels. The burner is also simple to construct and is capable of being scaled in size to match more efficiently varying system design requirements.

It is therefore one object of the present invention to provide a wall burner which will operate efficiently on both liquid and gas fuels.

It is another object of the present invention to provide an improved performance wall burner having a reduced overall size and cost.

It is still another object of the present invention to provide an improved wall burner with decreased operational costs and increased flame stability.

It is another object of the invention to provide a universal burner having decreased auxiliary air requirements.

The novel features believed characteristic of the present invention are set forth in the appended claims. The invention itself, however, together with further objects and advantages thereof, may best be understood with reference to the following description taken in connection with the appended drawings.

DETAILED DESCRIPTION OF THE INVENTION

Figure 1:
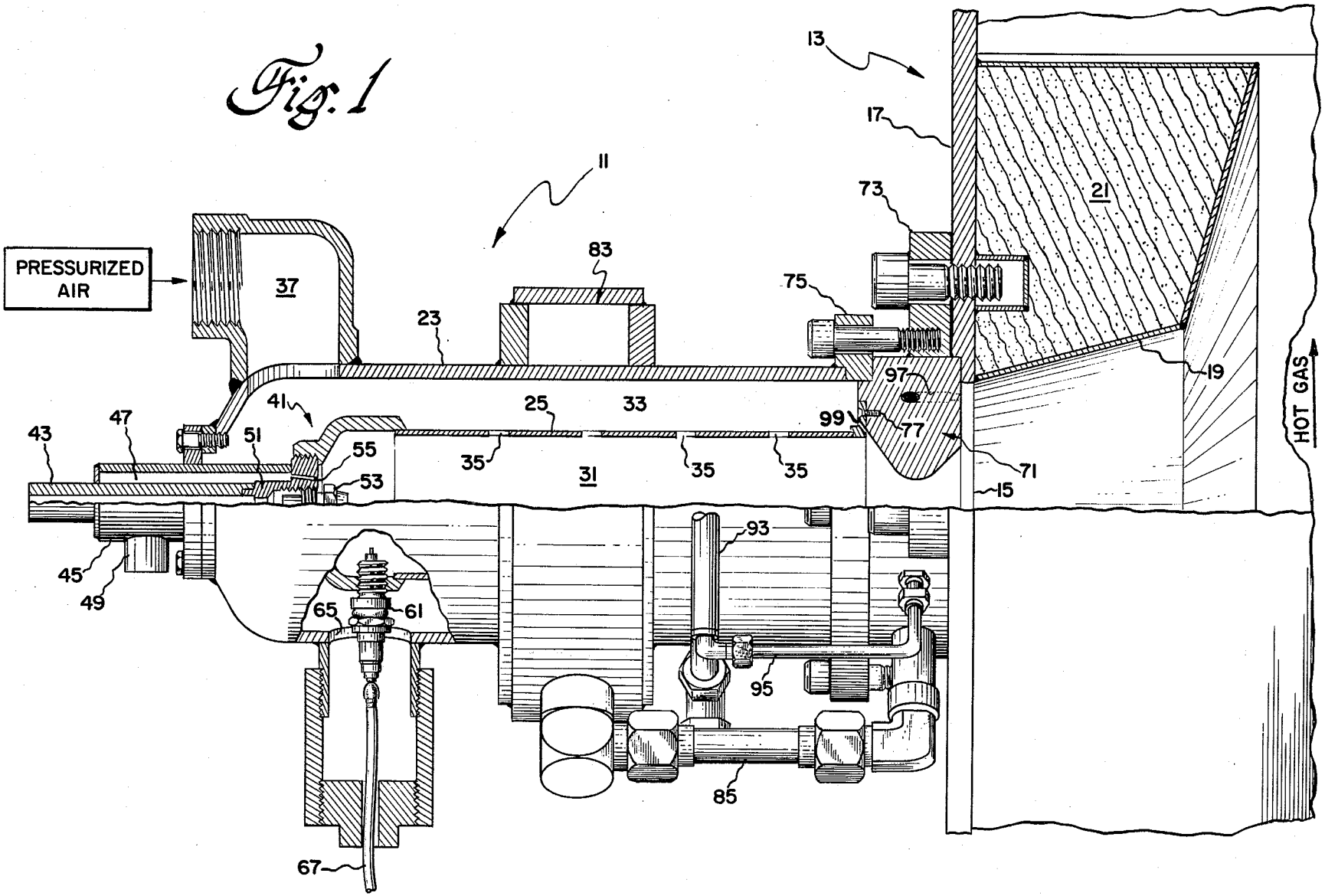
FIG. 1 is a partially sectioned elevation view of a wall burner according to the present invention.

In accordance with the appended drawings, a wall mounted burner 11 is arranged to fire into a duct 13 through a porthole 15 formed in the duct wall 17. The duct may be part of a Heat Recovery Steam Generator (HRSG) wherein a gas stream flowing through the duct is heated by one or more wall burners in order to provide heat to a boiler tube section (not shown) disposed downstream from the burners with respect to the gas stream flow and in the heated gas flow path. Such an arrangement is shown, for example, in U.S. Pat. No. 3,934,553 to Freeman et al issued Jan. 27, 1976. A frustro-conical diffuser and heat shield 19 is fixed to the duct wall immediately downstream from the porthole 15 and a suitable heat insulation 21 is supplied between the heat shield 19 and the duct wall 17.

The wall burner 11 includes a substantially cylindrical outer casing 23. A substantially cylindrical inner liner 25 is mounted within the outer casing having a centerline axis which is approximately coincident with the centerline axis of the outer casing. The inner liner volume 31 constitutes a pre-main combustion chamber. The inner liner is spaced from the outer liner so as to define an annular chamber 33 there between. The inner liner is perforate, that is, formed with a plurality of ports 35 which may be arranged in annular rows along the length of the inner liner. The outer casing further includes an air inlet conduit 37 which may be connected to a source of pressurized air. The air inlet conduit, the annular chamber and the perforated inner liner comprise a means for providing pressurized air into the pre-main combustion chamber. The source of pressurized air may be any air compressor well known in the art.

The wall burner of the present invention further includes means providing a relatively small amount of fuel, optimally one to two percent of the total fuel requirement, into the inner liner or pre-main combustion chamber. The means for providing fuel into the inner liner may be a gaseous fuel nozzle, a liquid fuel nozzle or a dual fuel nozzle. In a preferred embodiment shown, the fuel providing means is a dual fuel nozzle 41. The dual fuel nozzle 41 comprises a liquid fuel pipe 43 concentrically mounted within an outer pipe 45 to form an annular space 47 therebetween. Annular space 47 may be supplied with either gaseous fuel during gaseous fuel operation or atomizing air during liquid fuel operation. Inlet boss 49 is formed on the outer pipe to provide fluid communication into annular space 47. A swirler ring 51 is provided at the outlet end of the dual fuel nozzle having an outer circumference attached to the outer pipe and an inner circumference attached to the inner or liquid fuel pipe 43. A liquid fuel nozzle 53 is threaded into the outlet end of the liquid fuel pipe whereas the swirler ring includes a plurality (only one shown) of ports 55. Ports 55 are directed radially inwardly toward the burner centerline axis, and tengentially sidewise to induce swirl within the through flowing gases (air or gaseous fuel).

An ignitor in the form of a spark plug 61 is threaded into the inner liner 25 through an opening 65 formed in the outer casing. The spark plug and its associated electrical lead 67 provides a means for igniting a combustible mixture comprising gaseous fuel and air or liquid fuel and air formed in the pre-main combustion chamber 31.

An accelerator means is disposed at the downstream end of the pre-main combustion chamber between the duct wall and the outer casing and inner liner. The accelerator means comprises an accelerator ring 71 which includes a hyperbolic nozzle at its inner circumference. The accelerator ring is attached to the wall of the HRSG in approximate register with port 15 by means of mounting bracket lugs 73. A mounting ring 75 is used for attaching the outer casing to mounting bracket lugs 73 whereas the downstream end of the inner liner is attached to the accelerator ring by means of screws 77.

Figure 2:
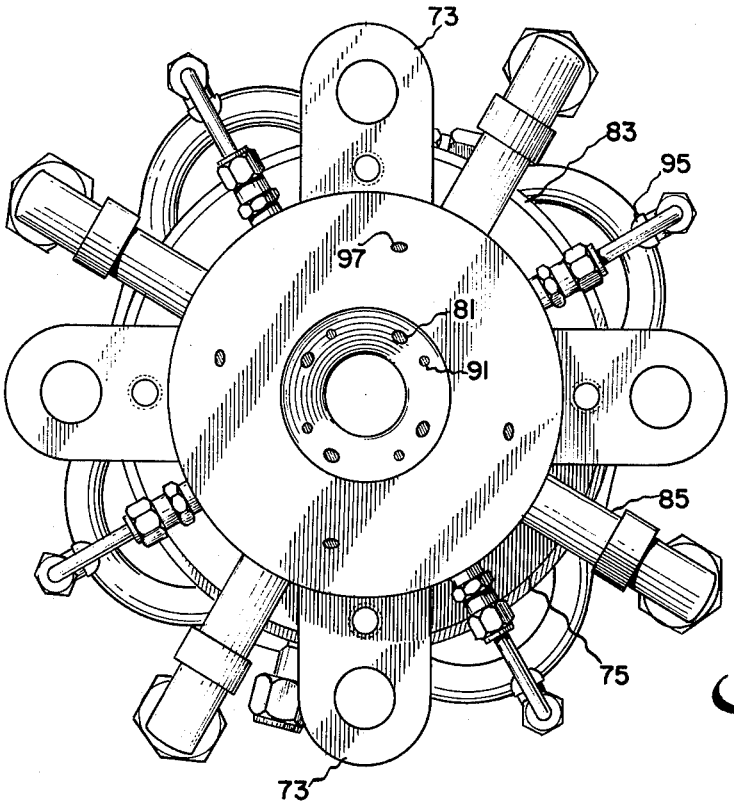
FIG. 2 is an end view of the wall burner taken at the wall mounting flanges and looking into the burner.

The burner according to the present invention further includes main fuel ports on the downstream side of the accelerator ring. Referring to FIG. 2, taken in connection with FIG. 1, and according to a preferred embodiment of the invention, a first set of fuel ports 81 is arranged in an annular pattern on the downstream side of the accelerator ring for injecting gaseous fuel into the accelerating combusting mixture being diffused from the accelerator ring. The gaseous fuel is delivered to fuel ports 81 from a gas manifold 83 through conduits 85. The gaseous fuel ports 81 are directed inwardly toward the centerline axis of the burner. Further, according to a preferred embodiment of the invention, a second set of fuel ports 91 is arranged in an annular pattern on the downstream side of the accelerator ring. Fuel ports 91 are liquid fuel ports for injecting liquid fuel into the accelerating combusting mixture being diffused from the accelerator ring. The liquid fuel is delivered to fuel ports 91 from a liquid fuel manifold 93 through conduits 95. The liquid fuel ports 91 are directed inwardly toward the centerline axis of the burner. While the foregoing described embodiment shows the most universal aspect of the invention, it should be clear that either the gaseous fuel ports and associated fuel delivery apparatus or the liquid fuel ports and associated fuel delivery apparatus could be eliminated to convert the preferred dual fuel burner into either a liquid fuel burner or a gaseous fuel burner respectively without departing from the scope of the invention. Optimally about ninety-nine or ninety-eight percent of the total fuel requirement is delivered through these main fuel ports.

The nozzle portion of the accelerator ring is air cooled by means of a plurality (only one shown) of cooling holes 99 which communicate the annular chamber 33, filled with compressed air, with the nozzle surface of the accelerator ring. Moreover, the accelerator ring is further air cooled by passages 97 which pass through the accelerator ring to the downstream side of the ring in communication with annular chamber 33. This air also purges the downstream side of the accelerator ring and eliminates any stagnation of recirculation gases in that region. Also, the injection of the main fuel (gaseous or liquid) through the accelerator ring provides additional cooling of the nozzle ring.

The fundamental combustion design of the burner, according to the present invention, inherently minimizes air pollution emissions during combustion. However, the design provides easy access for installation of an auxiliary injection system for air. Steam and/or other emission reducing additives. For examples, cooling air passages 97 may be utilized for providing auxiliary air injection for emission control. Alternatively, the gaseous fuel injection system may be used for emission reducing additives for operation with liquid fuels.

OPERATION

With the foreging description and drawings as an example, the following describes the general principles of operation of the invention:

A small amount of the total required fuel is input into the pre-main combustion chamber 31 through dual fuel nozzle 41. The percent fuel input into the chamber 31 is preferably in the range of from one to five percent of the total burner fuel requirement. The optimum range is one to two percent. If the burner is operating on gaseous fuel, the gaseous fuel enters chamber 31 through swirler ports 55. If the burner is operating on liquid (oil) fuel the liquid fuel enters chamber 31 through the liquid fuel nozzle 53. In combination with liquid fuel operation, atomizing air is introduced into the pre-main combustion chamber through swirler ports 55. Although it is not specifically shown, it is well known that either air or gaseous fuel may be input into annular space 47 by providing a three way valve connection upstream from inlet boss 49.

A quantity of oxidizer, proportionate to the inlet fuel through nozzle 41, is also input into chamber 31 as provided from an external source (not shown) through conduit 37, annular chamber 33 and perforated liner 25. The oxidizer may be, for example, air at the same inlet conditions as used for atomizing air in the dual fuel nozzle. Since only a small amount of fuel is injected into the pre-main combustion chamber only a correspondingly small amount of auxiliary air is necessary thereby reducing the combustion air requirements heretofore necessary in the prior art.

An energy source as, for example, spark plug 61 supplies a spark for initiating combustion of the combustible mixture formed in chamber 31. The spark plug may be a regular automotive type spark plug and is only required to operate at start-up and the energy supply may be terminated once steady-state combustion is achieved. Usually, the desired air-flow is first established through the inner liner volume followed by initiation of the electric spark discharge. Immediately thereafter, fuel flow is established in the pre-main combustion chamber. Within the pre-main combustion chamber, fuel and air mix at appropriate rates and the resulting combustible mixture ignites originally by means of the electric spark discharge energy and later by the inherent heat energy contained in the product of combustion recirculating gases adjacent the dual fuel nozzle port of the inner liner.

The ignited combusting mixture expands through the nozzle portion of the accelerator ring 71 which converts the pressure potential energy of the hot combusting mixture within the inner liner into a highly reactive jet with high velocity and momentum. Upon formation of the combusting jet, the main fuel injection process is initiated. The major portion of the total fuel required, for example, 95 to 99 percent, optimally 99 or 98 percent, may be injected through main fuel ports 81 or 91 on the downstream side of the accelerator ring. The gaseous fuel flows through pipes 85 into ports 81 to be injected as high velocity jets towards the combusting mixture exhausting from the accelerator ring. If the main fuel is liquid (oil) fuel, the liquid fuel flows through pipes 95 into ports 91 to be injected as high velocity jets towards the combusting mixture exhausting from the accelerator ring. The main fuel (liquid or gaseous) is blasted into fragments as soon as it is intercepted by the combusting mixture jet.

Heat and momentum are exchanged from the combusting mixture to the main fuel fragments during the time of contact and interaction between these two flowing components. As a result of the physical-chemical processes, the fuel fragments ignite and accelerate to a high velocity which carries them into the exhaust gas stream wherein the main combustion takes place. Combustion of the fuel fragments continues as they penetrate deeper and deeper into the exhaust gas stream, until all fuel fragments burn out using the oxygen of the exhaust gas stream.

The combustion system of a fired HRSG may comprise one or more wall burners mounted in various strategic locations on the exterior walls of the HRSG on the basis of size, firing requirements and overall design criteria. It is conceivable that flame holding devices may be utilized within the exhaust gas stream to enhance the flame penetration, distribution and stability. One example of a suitable flame holder is shown in U.S. Pat. No. 3,934,553 to Freeman et al issued Jan. 27, 1976.

Typical operational conditions of the burner may vary depending upon the application. However, according to tests conducted the following parameters were utilized:

| Inner Liner: | (Pre-Main Combustion Chamber) | |
|---|---|---|
| Ignition: | Air Flow Range | 30 to 50 SCFM |
| | Inlet Air Pressure | 1.5 to 3.5 PSIG |
| | Fuel Flow | 3 to 4 GP Hour |
| | Inlet Fuel Pressure | 100 to 150 PSIG |
| Regular Operation: | Air Flow Range | 30 to 350 SCFM |
| | Inlet Air Pressure Range | 3 to 30 PSIG |
| | Fuel Flow | 3 to 6 GP Hour |
| | Inlet Fuel Pressure | 70 to 300 PSIG |
| Main Fuel: | | |
| | Pressure | Flow Rate |
| Natural Gas | 0 to 25 PSIG | 0 to 27,000 SCF/HR |
| #2 Oil | 0 to 300 PSIG | 0 to 6.66 GPM |

-continued

| Inner Liner: | (Pre-Main Combustion Chamber) | |
|---|---|---|
| #6 Oil | 0 to 150 PSIG | 0 to 5.5 GPM |

While there has been shown what is considered, at present, to be a preferred embodiment of the invention, other modifications may occur to those skilled in the art; and, it is intended to cover in the appended claims all such modifications as fall within the true spirit and scope of the invention.

I claim:

1. An apparatus for raising the temperature of an exhaust gas stream flowing through a duct, the apparatus being mounted substantially transverse to the exhaust gas flow and outside the duct; and, the apparatus communicating with the exhaust gas stream through a porthole in the duct, the apparatus comprising:

a substantially cylindrical outer casing having a downstream end adjacent the duct;

a substantially cylindrical perforate inner liner disposed within the outer casing; the inner liner and the outer casing having an annular chamber therebetween;

means providing pressurized air into the inner liner;

means providing a relatively small amount of fuel into the inner liner for mixing with the air to form a combustible mixture;

means for igniting the fuel and air mixture in said inner liner;

means at the downstream end of the inner liner for accelerating the flow rate of the fuel and air mixture; and;

fuel ports on the downstream side of the accelerator means for providing a relatively large amount of fuel into the ignited mixture whereby the combustion process is continued in the exhaust gas duct.

2. The apparatus recited in claim 1 wherein the means for supplying a relatively small amount of fuel comrises a dual fuel nozzle at the upstream end of the inner liner.

3. The apparatus recited in claim 1 further comprising gaseous fuel ports and liquid fuel ports on the downstream side of the accelerator means whereby liquid fuel and gaseous fuel may be selectively injected into the accelerating flow of the combusting fuel and air mixture.

4. The apparatus recited in claim 1 further comprising a plurality of air channels interconnecting the annular chamber with the downstream side of said accelerator means, said air channels extending through said accelerator means.

5. The apparatus recited in claim 1 wherein the relatively small amount of fuel into the inner liner is in the range of from 1 to 5 percent of the total fuel consumption of the apparatus.

6. The apparatus recited in claim 1 wherein the relatively large amount of fuel from the downstream fuel ports is in the range of from 95 to 99 percent of the total fuel consumption of the apparatus.

7. The apparatus recited in claim 1 wherein the means providing pressurized air into the inner liner includes:

a source of pressurized air in fluid communication with said annular chamber; and, a plurality of ports arranged about said inner liner for admitting pressurized air into said inner liner.

8. The apparatus recited in claim 7 wherein the dual fuel nozzle may be selectively operated with gaseous fuel and liquid fuel; said dual fuel nozzle comprising:

a liquid fuel pipe having a liquid fuel nozzle at the downstream end thereof;

an outer pipe concentrically mounted about said liquid fuel pipe so as to define an annular space therebetween;

a swirler ring mounted at the downstream end of said outer pipe between said liquid fuel pipe and said outer pipe, whereby during gaseous fuel operation, gaseous fuel is supplied to said inner liner through said annular space and said swirler ring; and, during liquid fuel operation, liquid fuel is supplied to said inner liner through said liquid fuel nozzle and pressurized air is supplied to said inner liner through said annular space and said swirler ring.

9. The apparatus recited in claim 1 wherein the accelerator means comprises a substantially hyperbolic nozzle ring disposed between the downstream end of the inner liner and the duct porthole, the centerline axis of the nozzle ring approximately coincident with the centerline axis of the inner liner.

10. The apparatus recited in claim 9 further comprising a plurality of annularly spaced air holes communicating the annular chamber with the curved inner circumference of the accelerator nozzle ring.

11. A burner comprising:

an outer cylindrical casing;

a perforate, cylindrical inner liner within the outer casing, said inner liner and outer casing defining an annular chamber therebetween;

means providing combustion air into said inner liner through said annular chamber;

means providing a relatively small amount of liquid fuel into said inner liner for mixing with said combustion air to form a combustible mixture;

means for igniting said combustible mixture within said inner liner;

means at the downstream end of said inner liner for accelerating said combustible mixture; and, fuel ports on said accelerator means for providing a relatively large amount of liquid fuel into said ignited combustible mixture as it flows through said accelerator means.

12. A burner comprising:

a cylindrical outer casing;

a perforate, cylindrical inner liner within the outer casing, said inner liner and outer casing defining an annular chamber therebetween;

means providing combustion air into said inner liner through said annular chamber;

means providing a relatively small amount of gaseous fuel into said inner liner for mixing with said combustion air to form a combustible mixture;

means for igniting said combustible mixture within said inner liner;

means at the downstream end of said inner liner for accelerating said combustible mixture; and, fuel ports on the accelerator means for providing a relatively large amount of gaseous fuel into said ignited combustible mixture as it flows through said accelerator means.

13. A dual fuel burner operable on a liquid fuel or a gaseous fuel comprising:

a cylindrical outer casing;

a perforate, cylindrical inner liner within the outer casing, said inner liner and outer casing defining an annular chamber therebetween;

means providing combustion air into said inner liner through said annular chamber;

means providing a relatively small amount of liquid fuel or gaseous fuel into said inner liner for mixing with the air to form a combustible mixture;

means for igniting said fuel and air within said inner liner;

means at the downstream end of said inner liner for accelerating said combustible mixture; and fuel ports on the accelerator means for providing a relatively large amount of liquid fuel or gaseous fuel into said combustible mixture as it flows through said accelerator means.

* * * * *